US005152709A

United States Patent [19]

Johnson, III et al.

[11] Patent Number: 5,152,709

[45] Date of Patent: Oct. 6, 1992

[54] BEVERAGE INSULATING FLIGHT CYLINDER

[76] Inventors: Walter L. Johnson, III, 1711 Saddleback Dr., Daly City, Calif. 94014-3503; Steven W. Andersen, 17 Wordsworths Ct., Mill Valley, Calif. 94941

[21] Appl. No.: 740,300

[22] Filed: Aug. 5, 1991

[51] Int. Cl.[5] ..... A63H 27/00; B65D 61/00

[52] U.S. Cl. ..... 446/71; 446/61; 220/739; 215/12.1

[58] Field of Search ..... 446/61, 34, 68, 71; 273/425, 424, 428; 215/13.1, 12.1; 150/901; 220/732, 739, 737, 603; D21/82, 85, 86

[56] References Cited

U.S. PATENT DOCUMENTS

| | | | |
|---|---|---|---|
| 1,864,200 | 6/1932 | Kaufmann | 220/732 X |
| 2,683,603 | 7/1954 | Gackenbach | 273/425 |
| 3,264,776 | 8/1966 | Morrow | 446/34 |
| 3,473,682 | 10/1969 | Studen | 215/12.1 |
| 3,982,489 | 9/1976 | Flatau et al. | 446/34 X |
| 4,151,674 | 5/1979 | Klahn et al. | 446/34 |
| 4,194,627 | 3/1980 | Christiansen | 206/545 |
| 4,246,721 | 1/1981 | Bowers | 446/34 |
| 4,293,015 | 10/1981 | McGough | 150/901 X |
| 4,390,148 | 6/1983 | Cudmore | 244/19 |
| 4,561,563 | 12/1985 | Woods | 220/412 |
| 4,671,424 | 6/1987 | Byrns | 220/408 |
| 4,720,023 | 12/1988 | Jeff | 220/412 |
| 4,790,788 | 12/1988 | Hill | 446/61 |
| 4,850,923 | 7/1989 | Ethridge | 446/34 |
| 4,921,117 | 5/1990 | Mucciarone | 220/737 |
| 5,067,922 | 11/1991 | McMahon | 446/71 |

*Primary Examiner*—Mickey Yu
*Attorney, Agent, or Firm*—Larry D. Johnson

[57] ABSTRACT

A beverage insulating flight cylinder including a cylinder portion open at both ends and having a heavier annular segment at the leading end such that the center of gravity is located closer to that end. The device is adapted to enclose and insulate a beverage container, and when removed from such a container, can be used as an aerial toy.

3 Claims, 4 Drawing Sheets

BEVERAGE INSULATING FLIGHT CYLINDER

FIELD OF INVENTION

The present invention relates to aerial toys and in particular to a hand-launchable flying cylinder which also serves to thermally insulate a beverage can or bottle, and its contents, below ambient temperatures.

DESCRIPTION OF PRIOR ART

The first aerial toys became a form of amusement and utility with the development of kites and boomerangs. Airplanes, gliders, and sailing projectiles were the next toys to exploit the lift of an airfoil. The most recent types of flying toys incorporate the concept of rotational inertia by spinning on an axis as they are thrown. Such developments include flying disks, footballs, boomerangs, flying rings, and the topic at hand, flight cylinders. These devices are normally used outdoors in the yard, at the park, or at the beach for social entertainment.

Flight cylinders, as well as many aerial toys, are designed to be propelled both forward and with a rotational motion about its longitudinal axis. Footballs and flight cylinders are both launched with a motion commonly known as a "spiral".

Another family of devices, used in the same type of environment, and of similar shape, are the beverage insulators. These inventions are referred to as an insulating holder, jacket, cozy, container, or cooler. The first beverage insulators were originally designed from pipe and plumbing insulation. Later developments disclose many improvement utilities such as lid sealing, extracting zippers, condensation restriction, and collapsibility.

The following list discloses the prior art searched and referenced henceforward:

| U.S. Pat. No. | INVENTOR | DATE |
|---|---|---|
| 2,683,603 | GACKENBACH | 7/1954 |
| 3,264,776 | MORROW | 8/1966 |
| 4,151,674 | KLAHN et al | 5/1979 |
| 4,194,627 | CHRISTIANSEN | 3/1980 |
| 4,242,884 | KOTSCHWAR | 6/1981 |
| 4,246,721 | BOWERS | 1/1981 |
| 4,293,015 | McGOUGH | 10/1981 |
| 4,372,453 | BRANSCUM et al | 2/1983 |
| 4,390,148 | CUDMORE | 6/1983 |
| 4,478,265 | DeMARCO | 10/1984 |
| 4,534,391 | VENTIMIGLIA et al | 8/1985 |
| 4,561,563 | WOODS | 12/1985 |
| 4,671,424 | BYRNS | 6/1987 |
| 4,720,023 | JEFF | 12/1988 |
| 4,790,788 | HILL | 12/1988 |
| 4,850,923 | ETHRIDGE | 7/1989 |

Flight cylinders have had no commercial success. There are three major, and several minor, reasons why none have achieved popularity.

First, a flight cylinder is just a simplistic aerial toy. Without an additional utility, a flying toy is a mere object with which to play catch. A second or dual purpose must be incorporated so as to enhance the value of the device beyond a minimum level. A value must be attained which induces purchases from consumers or entices promotion from advertisers. The success and popularity of the flying disks can be attributed to the additional utility of the toy to be used for tricks. That supplementary utility increased the value and hence the popularity, success, and enjoyment. Without such an auxiliary function, the device will not keep the public's interest.

Second, success has not been attained because flight cylinders have not been associated with any other popular products or activities.

The third obstacle for success, in prior art flight cylinders, is the high cost of manufacturing. Most prior art have utilized injection molding of polypropylene or polyethylene, an expensive process in comparison to extrusion, the main process used in the manufacture of beverage insulators.

Beverage insulators have heretofore been used as a very inexpensive premium product, with a value so low that it is usually given away with a corporate logo imprinted. As with flight cylinders, the single utility has imposed a limit on its commercial success.

No beverage insulators were found to comprise a low center of gravity. Some ceramic mugs for coffee and tea have been comprised of heavier bottoms for better stability, especially in an automobile.

In reference to specific prior art, Morrow, Bowers, Hill, and Ethridge disclose a flight cylinder which is both expensive to produce and quite heavy. The preferred embodiments of said disclosures are comprised of materials characteristic of a very high durometer (hard), which poses a safety risk to those hit by the device. In addition, such a rigid and heavy aerial toy was found to be uncomfortable and painful to the fingers and knuckles of the hand which attempts to catch said projectile.

Klahn discloses an extremely lightweight flight cylinder comprised of tin or aluminum. This material can be xyresic, causing danger to passers-by and discomfort upon manual interception. In addition, metals are bent or crushed easily. Lastly, the cost to manufacture this device is high and difficulties, as described in Ethridge, are abundant.

Cudmore discloses a lightweight flight cylinder which lacks the surface area required to sustain the lift inherent in airfoil characteristics. In addition, the wing segments induce turbulence and contribute drag, hereby restricting a long amusing flight.

OBJECTS AND ADVANTAGES OF THE INVENTION

Accordingly, the objects and advantages of the present invention are as follows: to provide a device which is both an improved flight cylinder for amusement which also is an improved insulator for a cold beverage bottle or can.

More particularly, it is the object of this invention to provide a beverage insulator of greater economic value to the consumer, hereby overcoming commercial impediments encountered by prior art. This additional value is achieved by providing a device which further comprises amusement and entertainment functions as an aerial toy.

In addition, it is the object of this invention to yield a flight cylinder of greater economic worth to the consumer, hereby overcoming commercial impediments encountered by prior art. This additional value is achieved by providing a device which further comprises a beverage insulation utility.

Another object of the invention is to provide an improved insulating flight cylinder of which is constructed of a soft lightweight low-durometer material which therefore provides increased safety, durability, and comfort to the hand and fingers catching the aerial toy.

It is another object to produce an insulating flight cylinder which can be manufactured utilizing the inexpensive and economical process of extrusion, the operation inherent with the insulation industry.

An object of the present invention is to generate an improved beverage insulator which comprises a lower center of gravity, hereby enabling it to resist overturning and provide a more stable device, especially in a boat or automobile.

An additional flight cylinder object is to provide a predictable, long, gyroscopic, and balanced flight, hence amusement.

An object of the invention is to provide an insulating flight cylinder which, due to its cellular components, will float if dropped in a body of water.

Another object of the present invention is to provide a beverage insulator comprising a high degree of insulation for the purpose of maintaining a beverage container, and its contents, below ambient temperatures.

It is an object of the invention at hand to provide an improved beverage insulator comprising an additional lower aperture allowing easier removal of the beverage container upon consumption. Said opening prevents a vacuum from developing within the cavity created by the beverage container and the insulator. The orifice also allows fingers to be inserted, hereby pushing the container out of the chamber.

Aerial toys and beverage insulators (as well as other outdoors equipment) are commonly transported to beaches, parks, and campsites in hand held bags or backpacks. Such expeditions are limited by the volume and the weight of the knapsack. Thus it is an object of this invention to provide a combination invention which will reduce the overall space and weight, hence providing less to carry.

It is another object of the invention at hand to provide a beverage insulator that flies through the air, hereby providing a noticeable and eye-catching place for advertising a beverage logo or advertisement. In addition, such a device provides a beverage company with a premium product which is a sporting good, useful because a great deal of dollars are spent convincing athletes and their fans, to drink their cold beverage.

Lastly, it is an object of the invention to provide an insulating flight cylinder that is comprised of a smooth attractive aerodynamic design.

Further objects and advantages of the invention will become apparent from a consideration of the drawings and ensuing descriptions of them.

SUMMARY OF THE INVENTION

Accordingly, the present invention, a beverage insulating flight cylinder, accomplishes the aforementioned objects by providing a device, in the preferred embodiment, comprised of a straight, hollow, and longitudinally balanced cylinder, open at both ends, having a leading/lower end and a trailing/upper end, comprised of a soft cellular copolymer. The tube is comprised of a heavier annular segment at the leading end such that the center of gravity is located closer to the leading/lower end than the trailing/upper end. The device is adapted to enclose a beverage container permitting said container to be insulated from the ambient temperature and provide an enclosure with a stable low center of gravity. In addition, the device is adapted to be propelled with both a gyroscopic rotation along its longitudinal axis and a forward motion in the direction of flight. The aforementioned balancing, rotational inertia, and forward trajectory are the aspects of the device which cause it to exhibit airfoil characteristics and protracted flight.

The following parameters are preferred for the achievement and construction of the beverage insulating flight cylinder by one skilled in the art. The ratio of the total length to the diameter should be between 1:0.85 and 1:1.5. The ratio of the leading/lower end weight to the trailing/upper end weight should be between 3:1 and 1.6:1. In other words, center of gravity should be between 25% and 38% from the leading/lower end.

DRAWING REFERENCE NUMERALS

Figure 1:
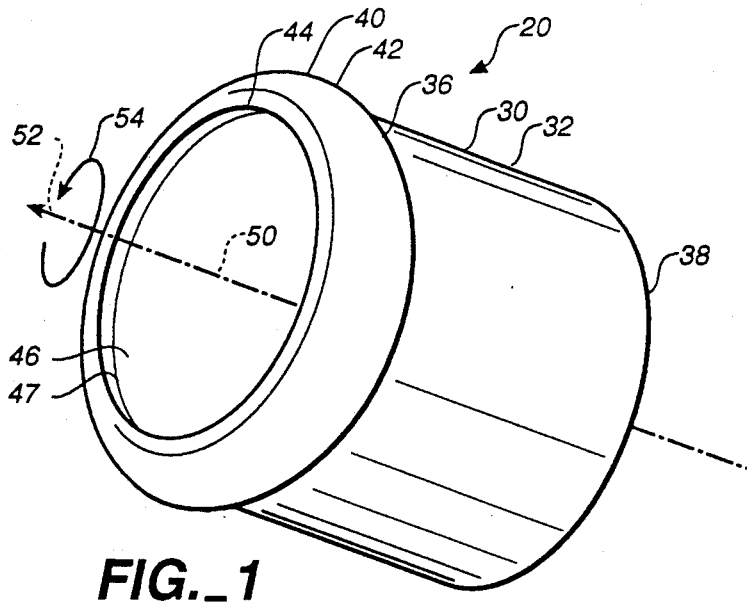
FIG. 1 is a perspective view of the preferred embodiment of the beverage insulating flight cylinder in accordance with the present invention.

20 beverage insulating flight cylinder
30 cylindrical body
32 outer body wall
34 inner body wall
36 seam
38 trailing/upper body end
40 annular nose segment
42 outer nose wall
44 leading/lower nose end
45 rabbet
46 inner nose wall
47 zenith
48 spoke
49 weight 50 longitudinal axis
52 flight direction
54 rotational direction
60 beverage can
62 hand
64 wrist
α angle of attack

DETAILED DESCRIPTION OF THE PREFERRED EMBODIMENTS

FIG. 1-13 show various views of various embodiments of the insulating flight cylinder in accordance with the present invention. The insulating flight cylinder is generally indicated as 20. Corresponding parts are designated by like reference numerals throughout all drawings: body parts referenced 30-39, nose parts referenced 40-49, orientation referenced 50-59, and other objects referenced as 60 or greater.

In all figures, insulating flight cylinder 20 comprises a substantially straight hollow cylindrical body 30, comprised of a cellular material which provides the present invention with insulation characteristics. Insulating flight cylinder 20 has a body 30 with a trailing/upper end 38 and a nose 40 with a leading/lower end 44. Body 30 is comprised of outer wall 32 and an inner wall 34 which comprises a substantially uniform wall thickness longitudinally along the axis of rotation 50. Annular nose segment 40 is comprised of outer nose wall 42 and inner nose wall 46.

Referring to FIGS. 1-6, the preferred embodiment, said insulating flight cylinder 20 is comprised of two components, body 30 and nose 40, which are joined at seam. Said components may be attached through the application of any adhesive compound. The cylinder body 30 is constructed of a cellular elastic copolymer which has a low specific gravity and a high insulation specification (K-factor or R-value).

The annular nose segment 40 is constructed of an elastic copolymer which has a high specific gravity. Said heavyweight nose material and lightweight body material will provide the transference of the center of gravity to the forward/lower third of the device. The aforementioned weighting is an aspect of the device which contributes to the invention's exhibition of airfoil characteristics, directional stability in the air, and static stability when utilized as a beverage insulator.

As shown in FIGS. 1-6, the annular nose segment 40 has a cross-sectional shape which is the shape of an airfoil. The outer nose wall 42 and inner nose wall 46 extend symmetrically from the apex, or leading/lower end 44, toward the adjoining seam 36 in a smooth streamline and aerodynamic shape, reaching a zenith 47. Outer nose wall 42 provides the device with an airfoil shape which causes lift and improves the flight characteristic of the device.

Figure 2:
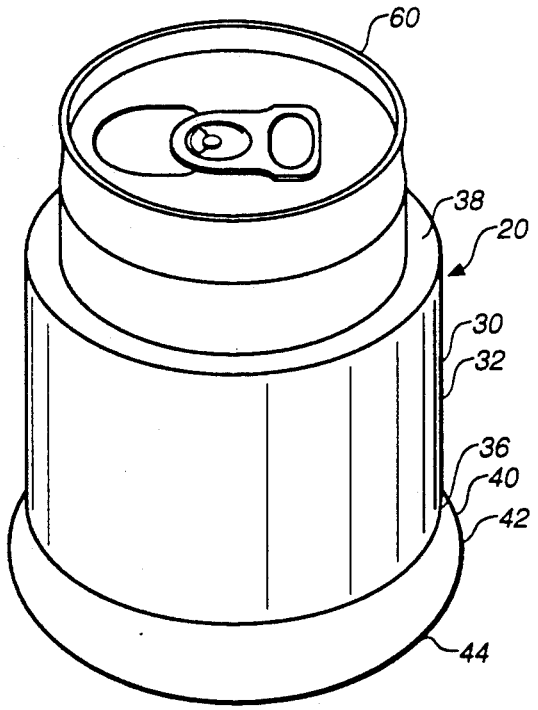
FIG. 2 is a perspective view illustrating the operation of the insulating flight cylinder as a beverage container stand and insulator.

Referring to the utility view FIG. 2, a beverage can 60 or bottle is placed within the cylindrical body 30 to provide insulation from the ambient temperature around outer body wall 32. Inner nose wall 46 provides us with a member, because of its smaller diameter at the zenith 47, which will prevent an inserted beverage container 60 from sliding completely through the insulating flight cylinder 20. Insulating flight cylinder 20 has a center of gravity in the lower third of the device, thus providing improved stability against lateral movement. Because annular nose segment 40 is comprised of a hollow ring, removal of the beverage container 60 is enhanced for the user hereby allowing fingers to push the container out. The prior art of most beverage insulators are comprised of a closed leading/lower end, thus creating a vacuum and preventing easy removal of the beverage container.

Figure 3:
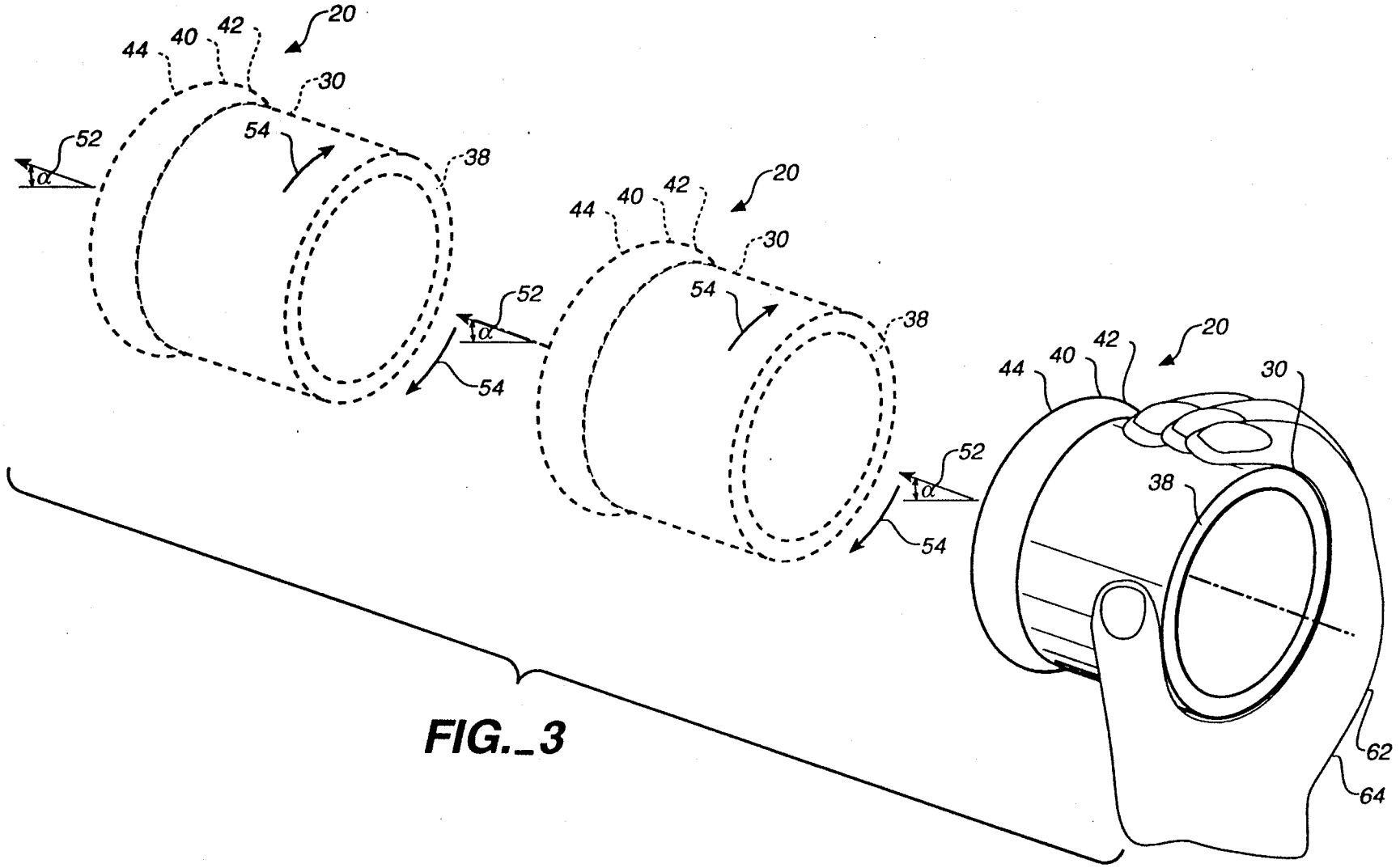
FIG. 3 is a perspective view illustrating the operation of the insulating flight cylinder as an aerial throwing toy.

FIG. 3 shows a perspective and operational view of insulating flight cylinder 20 which is an aerial toy that is intended to be launched by hand 62 in a forward direction 52. Upon release of said projectile 20, the leading edge 44 is pointed upward slightly in relation to the direction of flight 52. The angle between the direction of flight 52 and the longitudinal axis 50 is referenced as the angle of attack α. In addition to forward momentum imparted on the projectile upon release, a rotational motion 54 or "spiral" is also required to achieve flight. A downward snap of the wrist 64, upon launching, will inflict a gyroscopic motion 54 which produces rotational inertia that permanently fixes the angle of attack α throughout the flight path 52. These two motions, rotational 54 and forward 52, together with the ring airfoil shape and forward weighting are believed to be the four factors crucial to achieve a long protracted flight characteristic.

Figure 4:
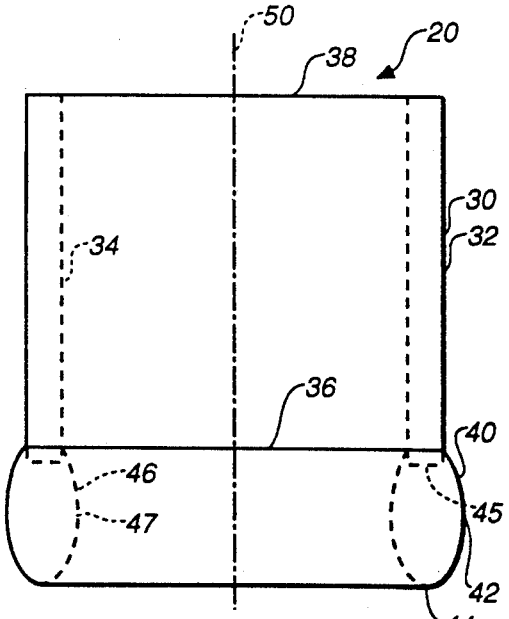
FIG. 4 is an elevational view of the preferred embodiment of the insulating flight cylinder.

FIG. 4 shows an elevational view of the preferred embodiment of the present invention.

Figure 5:
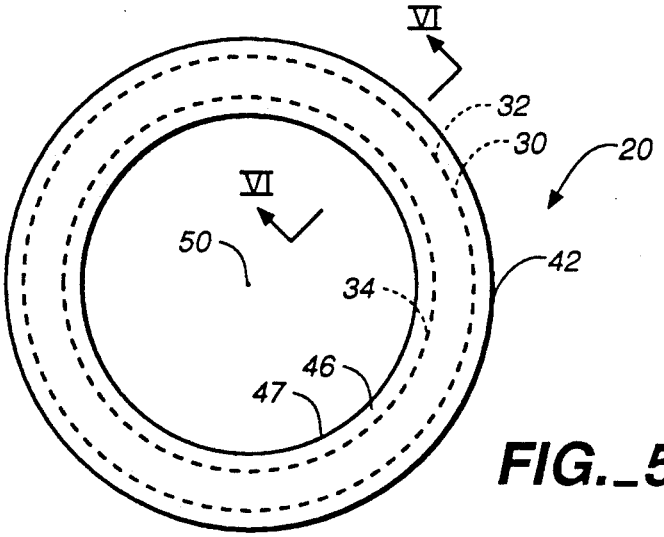
FIG. 5 is an end view of the leading/lower end of the preferred embodiment.

FIG. 5 shows a leading/lower end view of the insulating flight cylinder 20 in this preferred embodiment.

Figure 6:
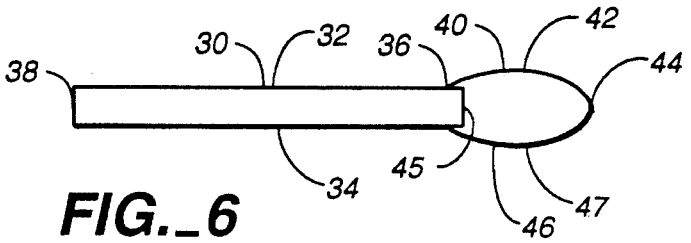
FIG. 6 is a sectional view taken along the line VI-VI of FIG. 5, illustrating the cross-sectional shape of the sidewall in the preferred embodiment.

FIG. 6 shows a sectional view taken along line VI—VI of FIG. 5, illustrating the symmetrical cross-section of the body 30 and the nose 40 in the preferred embodiment. The concentric rabbet 45, comprising the aft/top section of the annular nose segment 40, encases the leading section of the cylindrical body 30. Standard adhesives may be used to bond the two assemblies together permanently.

Figure 7:
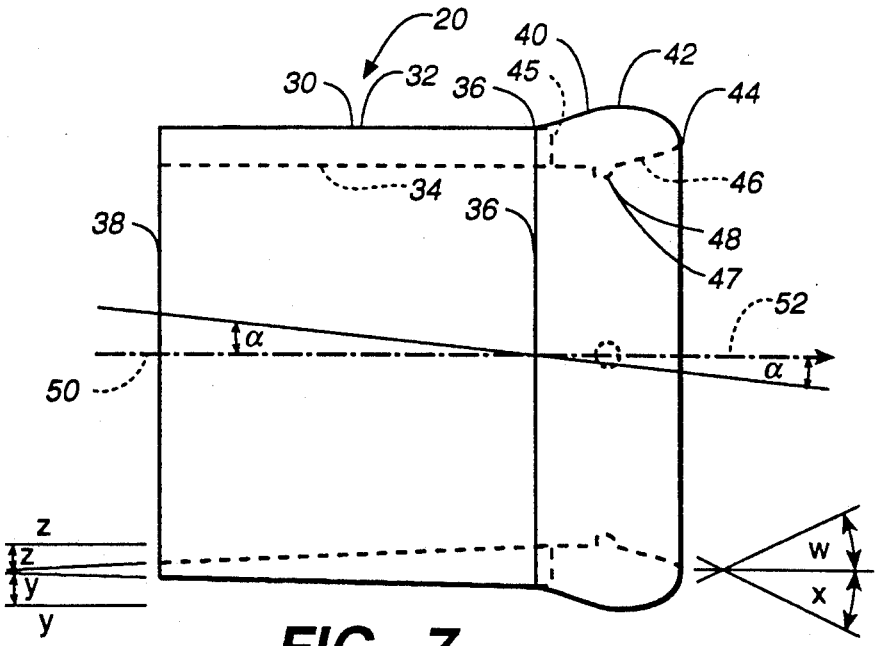
FIG. 7 is an elevational view of an alternative embodiment illustrating both an improved airfoil and restricting means.

FIG. 7 shows an alternative embodiment in an elevational view. The embodiment at hand utilizes a number of substantially short spokes 48 (bumps) which extend radially inward from the inner nose wall 46 and form the zenith 47 of a cross section bisecting said spokes 48. Said spokes 48 provide a restricting means of preventing an inserted beverage container 60 from sliding completely through the insulating flight cylinder 20.

The alternative embodiment FIG. 7 illustrates an improved airfoil shape which enhances the lift to drag ratio and hence protracted flight. One skilled in the aeronautical engineering art would find angle w and identical angle x are to be efficient between 12° and 20°. Angle y and identical angle z are believed to be efficient between ½° and 2°.

FIGS. 8-13 show partly broken sectional views of alternative embodiments.

Figure 8:
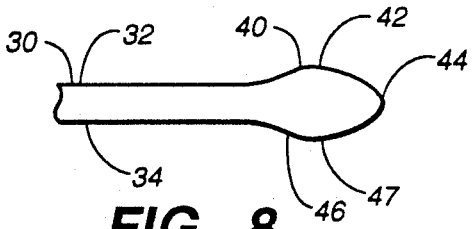
FIG. 8 is a broken sectional view of another alternative embodiment illustrating a substantially unitary construction of the preferred embodiment.
Figure 9:
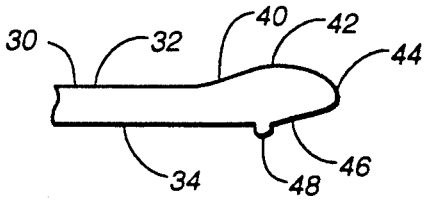
FIG. 9 is a broken sectional view of another alternative embodiment illustrating a substantially unitary construction of the alternative embodiment of FIG. 7.

FIGS. 8 and 9 show a substantially unitary construction of the beverage insulating flight cylinder 20 illustrated in FIGS. 6 and 7, respectively.

Figure 10:
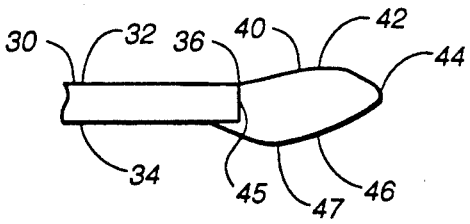
FIG. 10 is a broken sectional view of another alternative embodiment illustrating a substantially linear outer nose wall.

FIG. 10 shows an annular nose segment 40 comprised of a substantially linear outer nose wall 42.

Figure 11:
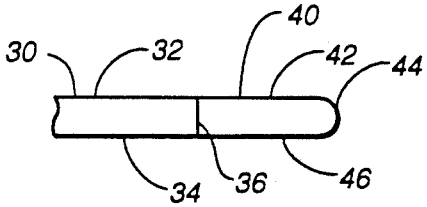
FIG. 11 is a broken sectional view of another alternative embodiment illustrating both substantially linear inner and outer nose walls.

FIG. 11 shows an annular nose segment 40 comprised of both substantially linear outer nose wall 42 and inner nose wall 46.

Figure 12:
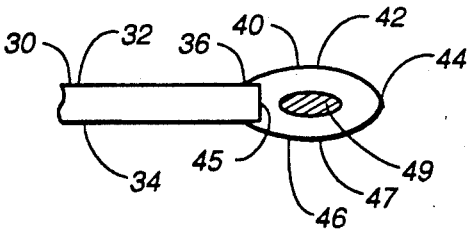
FIG. 12 is a broken sectional view of another alternative embodiment illustrating a solid weighting means.

FIG. 12 shows an annular nose segment 40 comprised of a weighting means which is encased within, or at the base of, said annular nose segment 40.

Figure 13:
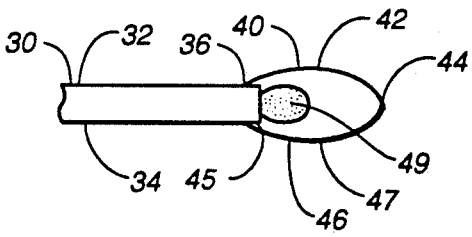
FIG. 13 is a broken sectional view of another alternative embodiment illustrating a granular weighting means.

FIG. 13 shows an annular nose segment 40 comprised of a weighting means which is substantially granular, and thus variable in weight.

Thus the reader will see that the insulating flight cylinder of the present invention provides an amusement utility, as an aerial toy, and a functional utility, as a beverage container insulator. Furthermore, the invention at hand provides a device that is durable, soft, easy to manufacture, safe, and pleasurable to catch and hold. Said device is shown to provide an excellent advertising medium for beverage companies, a high level of insulation from ambient temperatures, an ability to float, an attractive aerodynamic design, a predictable long flight, an ability to easily be separated from a beverage container, and a stable low center of gravity. As a single device, the present invention takes up less space and bears less weight when transporting to remote outdoor locations. Together, aforementioned objects and advantages of the beverage insulating flight cylinder provides both the consumer and the seller of the device with enough added value to overcome the poor commercial success of the prior art.

While the above description contains many specificities, these should not be construed as limitations on the scope of the invention, but rather as an exemplification of one preferred embodiment thereof, many other variations are possible.

For example, one skilled in the art would envision making the device out of a variety of different materials in a variety of different weights and dimensions.

Those proficient in the trade could produce a disposable lightweight embodiment to be given away with a purchase. Such a configuration could be devised from a paper cup with removable portions discarded after fountain beverage consumption, transforming into a flight cylinder.

A disposable lightweight embodiment could be devised, by adept artisans from thin polyurethane foam and formed directly on a beverage bottle. The consumer would purchase the bottle, encased in the beverage insulating skin, and remove the device for flight cylinder entertainment purposes.

Skilled artisans could attach additional weights, wings, or assemblies to provide different flight characteristics, including a floating helicopter effect with a protracted free fall.

A variety of aerodynamic shapes could readily be devised with more or less curves and airfoil properties.

Substantially longitudinal ridges or grooves could be provided on the outer surface of the cylinder to provide better grip or the ability to impart a more efficient rotational inertia upon launching said aerial toy.

One skilled in the art could adapt a whistling means to induce resonance and an audio appeal.

A rod or stick could be employed as a launching apparatus or intercepting device. Said rod or stick could comprise helical ridges or grooves with which to impart rotational inertial.

Accordingly, the scope of the invention should be determined not by the embodiment(s) illustrated, but by the appended claims and their legal equivalents.

We claim:

1. A combination flying toy and beverage insulating jacket device comprising:

an open-ended tubular body having a lower end and an upper end, the tubular body having an annular side wall, said side wall having an inner body surface and an outer body surface;

an annular nose segment at the lower end comprising a material of substantially higher mean specific gravity than said tubular body, said annular nose segment having an annular side wall, said side wall having an inner nose surface and an outer nose surface, said inner nose surface having a smaller diameter than said inner body surface, and comprising a number of spokes which extend radially inward;

said outer nose surface comprises an airfoil means for creating lift on the outer surface of said annular nose segment and said outer body surface when forward motion is imparted on said flying toy;

said annular nose segment comprising a material of substantially less elasticity than said tubular body, thus providing an impeding means which prevents an inserted beverage container from moving completely through said annular nose segment;

said tubular body is comprised of a material which provides insulating means between said inserted beverage container and the ambient temperature around the device.

2. A combination aerial toy and beverage insulator device comprising:

a hollow cylindrical body having a leading end and a trailing end, said cylindrical body having an annular side wall, said side wall having an inner body surface and an outer body surface;

an annular nose segment at the leading end comprising a material substantially denser than said cylindrical body, said annular nose segment having an annular side wall, said side wall having an inner nose surface and an outer nose surface, said inner nose surface comprising a number of spokes which extend radially inward, said outer nose surface comprising airfoil means for generating lift on the outer surface of said annular nose segment and said cylindrical body as the aerial toy travels through the air;

said cylindrical body is comprised of a material which provides insulating means between an inserted beverage container and the ambient temperature around the device;

said inner nose surface is of a smaller diameter than said inner body surface, thus providing a restricting means which prevents said inserted beverage container from passing through said annual nose segment.

3. A combination aerial toy and beverage insulator device comprising:

a hollow cylindrical body having a leading end and a trailing end, said cylindrical body having an annular side wall, said side wall having an inner body surface and an outer body surface;

an annular nose segment at the leading end comprising a material substantially denser than said cylindrical body, said annular nose segment having an annular side wall, said side wall having an inner nose surface and an outer nose surface, said inner nose surface having a smaller diameter than said inner body surface, thus providing a restricting means preventing said inserted beverage container from passing through said annular nose segment, and comprising a number of spokes which extend radially inward, said outer nose surface comprising airfoil means for generating lift on the outer surface of said annular nose segment and said cylindrical body as the aerial toy travels through the air;

said cylindrical body is comprised of a soft cellular material;

said annular nose segment is comprised of an impact dampening means for imparting a smooth transference of a moving flight cylinder's momentum to a human being upon interception;

said annular nose segment is comprised of a weighting means to move the center of gravity to the forward third of the device.

* * * * *